US006155702A

United States Patent [19]

Blusseau et al.

[11] Patent Number: 6,155,702

[45] Date of Patent: Dec. 5, 2000

[54] ELLIPTICAL HEADLAMP WITH ENLARGED ILLUMINATING AREA

[75] Inventors: Eric Blusseau, Rueil Malmaison; Gérard Billot, Montfermeil, both of France

[73] Assignee: Valeo Vision, France

[21] Appl. No.: 09/185,052

[22] Filed: Nov. 3, 1998

[30] Foreign Application Priority Data

Nov. 4, 1997 [FR] France ..... 97 13846

[51] Int. Cl.[7] ..... F21V 5/00

[52] U.S. Cl. ..... 362/520; 362/332; 362/521; 362/538; 362/539

[58] Field of Search ..... 362/520, 521, 362/522, 328, 509, 516, 517, 538, 539, 332

[56] References Cited

U.S. PATENT DOCUMENTS

| | | | |
|---|---|---|---|
| 4,722,023 | 1/1988 | Arima et al. | 362/80 |
| 4,797,790 | 1/1989 | Brodling et al. | 362/61 |
| 4,814,950 | 3/1989 | Nakata | 362/61 |
| 4,922,385 | 5/1990 | Bockeler et al. | 362/61 |
| 4,949,226 | 8/1990 | Makita et al. | 362/61 |
| 5,117,335 | 5/1992 | Yamada | 362/61 |
| 5,353,204 | 10/1994 | Kawamura | 362/61 |
| 5,718,505 | 2/1998 | Daumueller et al. | 362/279 |

FOREIGN PATENT DOCUMENTS

| | | |
|---|---|---|
| 0 273 353 | 7/1988 | European Pat. Off. . |
| 0 581 048 | 2/1994 | European Pat. Off. . |
| 32 18 703 | 11/1983 | Germany . |
| 195 19 872 | 12/1996 | Germany . |

*Primary Examiner*—Stephen Husar
*Assistant Examiner*—John Anthony Ward
*Attorney, Agent, or Firm*—Morgan & Finnegan, LLP

[57] ABSTRACT

A motor vehicle headlamp comprises an ellipsoidal reflector with two focus regions, a light source in the region of the first focus and a convergent lens focused on the region of the second focus. At least one optical plate exposed to light emitted directly by the light source includes an optical processing arrangement which returns at least a part of the direct light into the illumination field of the headlamp. An intermediate framework part fixed to the reflector is provided between the reflector and the lens and the intermediate part includes an arrangement for fixing the optical plate. Applications include elliptical headlamps with an enlarged illuminating area.

24 Claims, 3 Drawing Sheets

ELLIPTICAL HEADLAMP WITH ENLARGED ILLUMINATING AREA

FIELD OF THE INVENTION

The present invention concerns elliptical headlamps for motor vehicles.

DESCRIPTION OF THE PRIOR ART

A headlamp for motor vehicles conventionally comprises an ellipsoidal reflector with two focus regions, a light source in the region of the first focus, a convergent lens focused on the region of the second focus and, if necessary, a masking screen in the region of the second focus so that the lens projects towards the road an image representative of a beam with a cutoff, for example a low beam.

A headlamp of the above kind is beneficial in that it has a high light output and small dimensions in the direction transverse to the general direction of emission (optical axis) of the headlamp.

It nevertheless has certain drawbacks associated with the fact that a very large amount of light is emitted through the lens, the area of which is significantly less than that of the front-glass of a conventional parabolic headlamp.

This drawback is all the greater if the headlamp is equipped with a gas discharge lamp, well-known for its high light output.

Accordingly, drivers of vehicles travelling in the opposite direction will feel more dazzled than they would be by a parabolic headlamp emitting the same quantity of light because of the small dimensions of the illuminating area, i.e. of the lens.

In some prior art headlamps this drawback is mitigated. In particular, GB-A-1 196 109 and FR-A-2 229 920 describe headlamps in which a headlamp part based on the elliptical principle is combined with a headlamp part based on the parabolic principle. DE-A-32 18 703 describes a headlamp in which the lens of an elliptical headlamp is housed in and glued into a central opening in a larger plate, the plate being adapted to receive the light emitted directly by the light source and to redirect it, deviated by appropriate refringent members, towards the required field of illumination.

This prior art headlamp has certain drawbacks, however. Primarily, manufacture entails gluing the lens into a specific opening formed in another component This makes the headlamp difficult to manufacture and can lead to inaccuracies in the positioning of the lens and therefore to incorrect positioning of the beam on the road.

Another drawback of the above prior art headlamp is that no industrial means are described for accurate assembly of the reflector, the lens and, where included, the masking screen.

The present invention aims to mitigate the above drawbacks of the prior art and to propose an elliptical headlamp with an enlarged illuminating area in which retaining means are provided for retaining the optical component or components enlarging the illuminating area and in which the optical component or components in question can be selectively included or omitted, in the latter case the headlamp constituting a conventional elliptical headlamp.

SUMMARY OF THE INVENTION

To this end the invention proposes a motor vehicle headlamp comprising an ellipsoidal reflector with two focus regions, a light source in the region of the first focus and a convergent lens focused on the region of the second focus, and at least one optical plate exposed to light emitted directly by the light source and including optical processing means adapted to return at least a part of the direct light into the illumination field of the headlamp, wherein an intermediate framework part fixed to the reflector is provided between the reflector and the lens and the intermediate part includes fixing means for fixing the optical plate.

Preferred but non-limiting aspects of the headlamp in accordance with the invention are as follows:

- the intermediate part includes fixing means for fixing the lens and fixing means for optionally fixing the at least one optical plate.
- the fixing means for optionally fixing the optical plate or each optical plate comprise an arrangement on the intermediate part extending along and in the vicinity of a corresponding edge of the reflector.
- the optical plate or each optical plate has adjacent the lens an edge adapted to espouse a corresponding edge of the lens and along which there is provided an arrangement complementary to the arrangement on the intermediate part.
- the lens and the optical plate or plates are made in one piece.
- the intermediate part includes retaining means for retaining the one-piece part at least by two of its opposite edges.
- the intermediate part flares out from the reflector towards the opposite edges.
- two optical plates are provided on respective opposite sides of the lens.
- the optical plates are disposed laterally relative to the lens.
- the optical plate or each optical plate comprises light deflecting means and light diffusing means.
- the reflector and the intermediate framework part comprise two members each made in one piece and assembled together in a direction substantially transverse to the optical axis of the headlamp.

Other aspects and advantages of the invention will become more apparent after reading the following detailed description of preferred embodiments of the invention given by way of non-limiting example and with reference to the accompanying drawings.

DETAILED DESCRIPTION OF THE PREFERRED EMBODIMENTS

Figure 1:
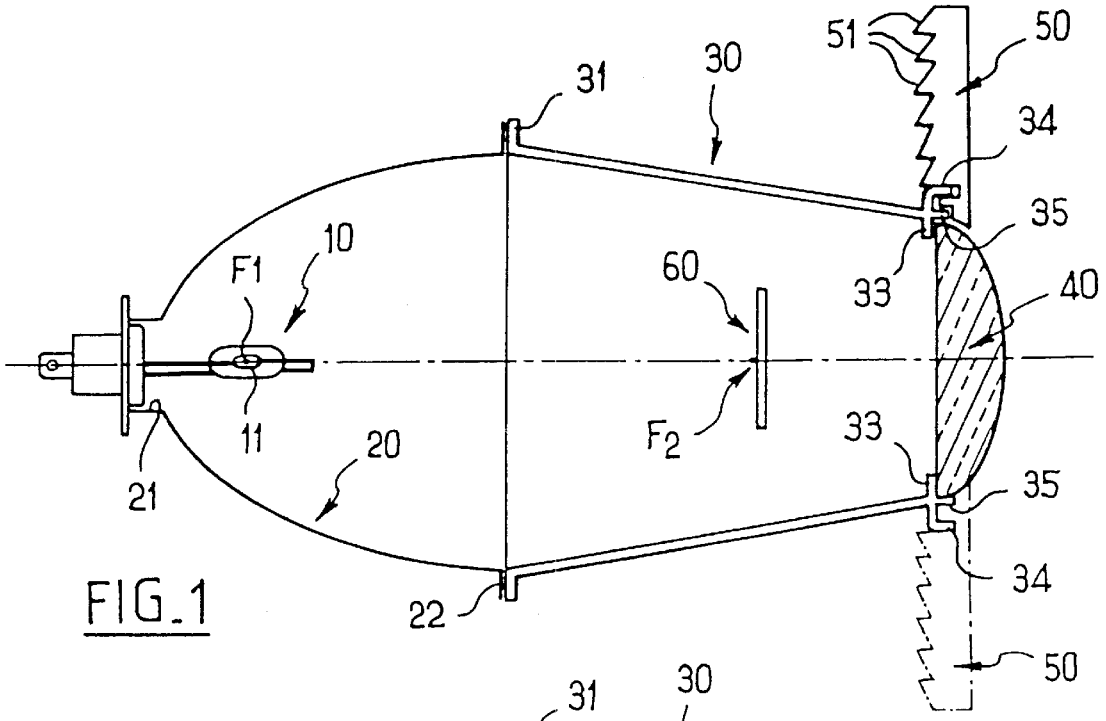
FIG. 1 is a view in horizontal section of a first embodiment of a headlamp in accordance with the invention.
Figure 2:
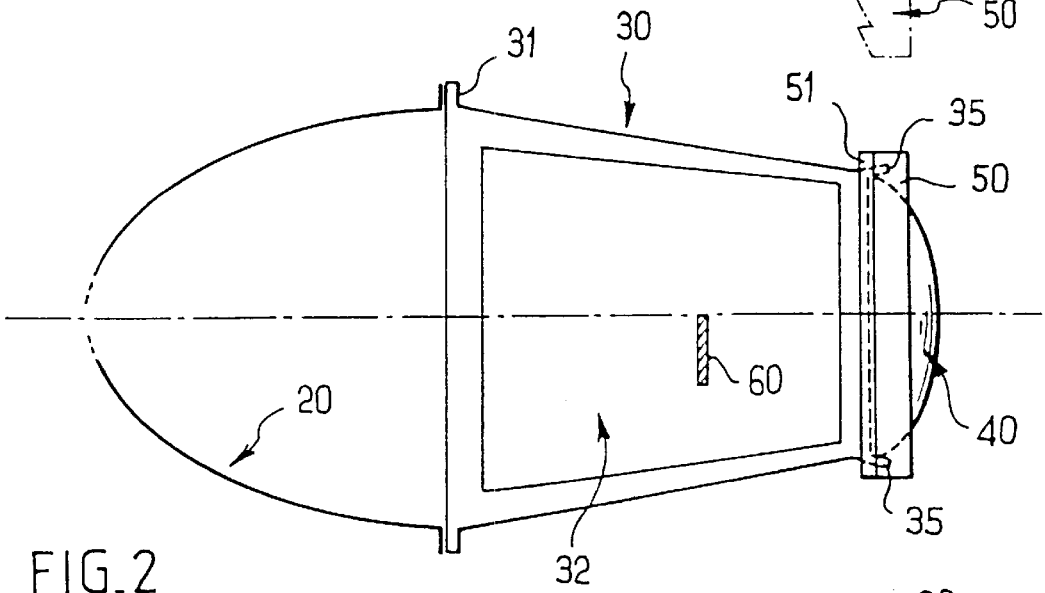
FIG. 2 is a side view of the lamp from FIG. 1.
Figure 3:
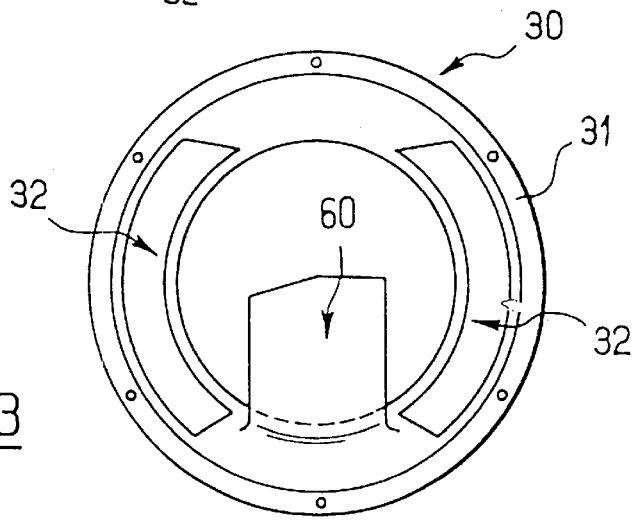
FIG. 3 is a back view of a component of the headlamp from FIGS. 1 and 2.

FIGS. 1 to 3 show an elliptical headlamp for motor vehicles which includes a reflector 20 having the general shape of a portion of an ellipsoid with two focus regions F1 and F2 on the optical axis x—x of the headlamp. A lamp 10, in this instance a discharge lamp, is mounted in a lamp hole 21 in the reflector 20 and defines a light source 11 in the form of a bright arc which is located in the region of the first focus F1.

The headlamp also includes a generally tubular intermediate part 30 which is mounted on the front edge of the reflector 20 by means of a flange 31 at one end. At the other end it has arrangements for mounting a plano-convex lens 40 the focus of which is in the region of the second focus F2.

In this example the arrangements referred to comprise bearing lugs 33 (or a continuous flange) against which the plane face of the lens 40 bears and crimping lugs 35 gripping the periphery of the lens.

The part 30 is bent to shape from sheet metal, for example, and also defines a masking screen 60 in a plane perpendicular to the optical axis x-x and near the region of the second focus F2.

In the form described above the headlamp is a conventional elliptical headlamp adapted to project onto the road a beam with a cutoff, for example a low beam with a standardised "V" cutoff, the photometric configuration of which is created in the vicinity of the second focus F2.

In accordance with one aspect of the invention, the above headlamp is provided with means for selectively adding two optical plates 50 to increase the size of the illuminating area of the headlamp, in the present instance on respective opposite sides of the lens.

FIGS. 1 and 2 show one of these optical plates, extending laterally and substantially in alignment with the plane face of the lens 40. It has light processing arrangements 51 on its inside surface. To assure continuity of appearance with the lens, whether the headlamp is turned on or off, the inside edge of each plate 50 is a hollow circular arc shape, so as to espouse the corresponding edge of the lens 40.

Each plate 50 is exposed to the light coming directly from the source 11, to which end the intermediate part has two lateral windows 32 (see FIGS. 2 and 3) allowing this light to reach the inside face of said plates.

In this instance the optical arrangements 51 are prisms oriented vertically and adapted to deflect light from the source that has passed through the windows 32 in a direction essentially parallel to the optical axis. As a result the headlamp when turned on gives a visual impression of a larger illuminating area, either for styling reasons or for the visual comfort of drivers of vehicles travelling in the opposite direction, given that the impression of being dazzled is reduced by the presence of the two lateral extensions 50 of the lens, which also emit light.

The plates 50 can be selectively fixed to the intermediate part 30 by any appropriate means. In this instance, these means comprise ribs in the form of curved blades 34 in one piece with the part 30 and running along the lateral contours of the lens 40. The ribs are glued into complementary grooves on the inside face of the plates 50 near their respective inside edge.

Accordingly, in this first embodiment of the invention the same basic components, namely the lamp 10, the reflector 20, the intermediate part 30 and the lens 40, can be used to produce either a conventional elliptical headlamp or, by adding the plates 50, an elliptical headlamp with an enlarged illuminating area.

The unit cost of the headlamps remains reasonable and the number of parts to be held on inventory remains limited.

Figure 4:
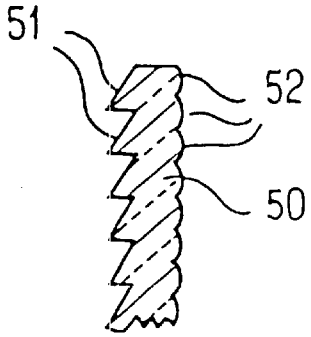
FIG. 4 is a view showing a detail of a variant of part of the headlamp from FIGS. 1 to 3.

FIG. 4 shows a variant optical plate 50.

The plate has on its inside face the prisms 51 described above and con its outside face a regular arrangement of spherical or toroidal balls 52, or equivalent optical components, for diffusing the light after it has been deflected by the prisms 51.

As a result, the light emitted through said plates 50 is visible within a large observation cone to the front of the vehicle so that the psychological effect of reduced dazzle can be obtained in a vast range of observation points in front of the vehicle.

Figure 5:
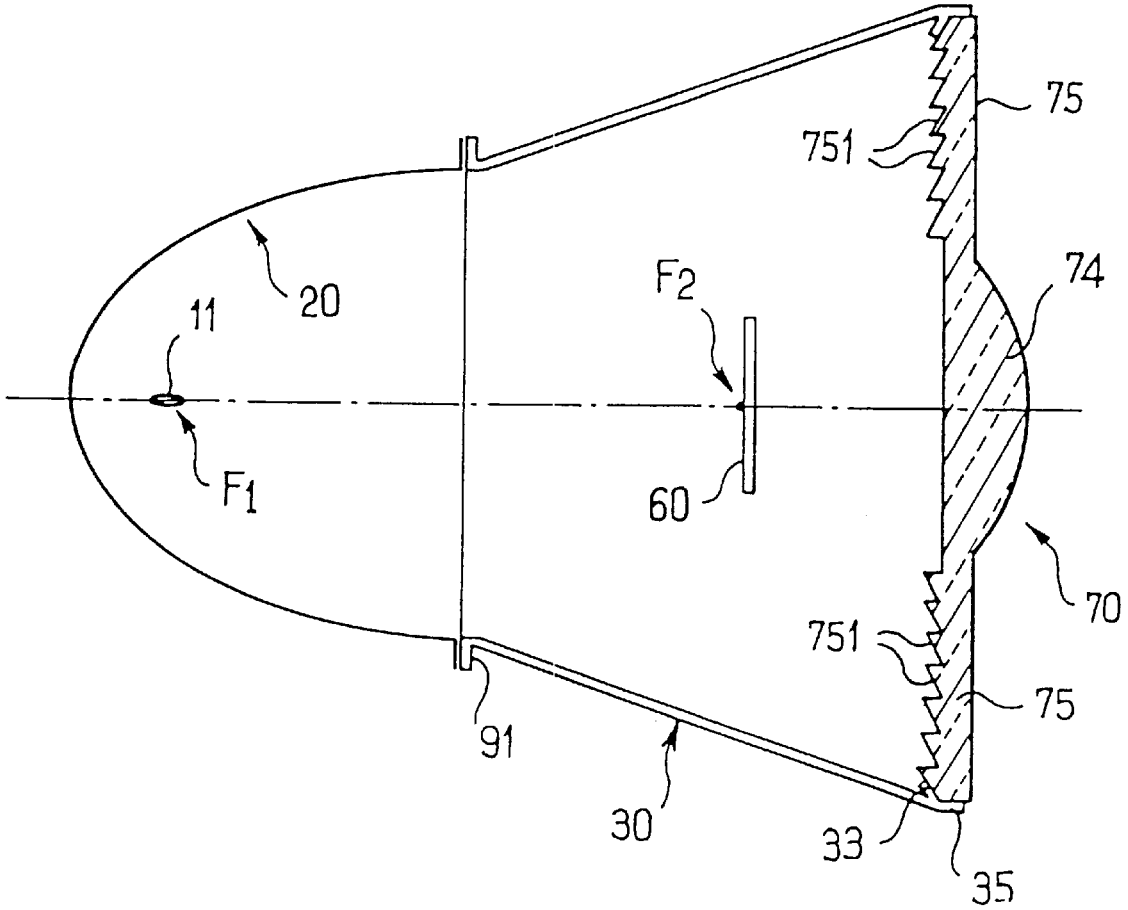
FIG. 5 is a view in horizontal axial section of a second embodiment of a headlamp in accordance with the invention.

A second embodiment of the invention will now be described with reference to FIG. 5.

This embodiment uses a one-piece optical component 70 which defines the lens (the part 70) and two lateral optical plates 75, 75, the combination having the same optical properties as the lens 40 and the plates 50, 50 of the FIG. 3 embodiment.

This solution simplifies assembly and reduces the cost of an elliptical headlamp with an enlarged illuminating area.

In this case the intermediate part 30 is adapted to position and to retain the whole of the component 70 at the end opposite the reflector.

Accordingly the part 30 has walls which flare out in the direction towards the lateral edges of the element 70. In this case, because the plates 75, 75 are exposed directly to light from the source through the single interior gap of the part 30, it is not necessary to provide the latter with special windows for the direct light to pass through.

Figure 6:
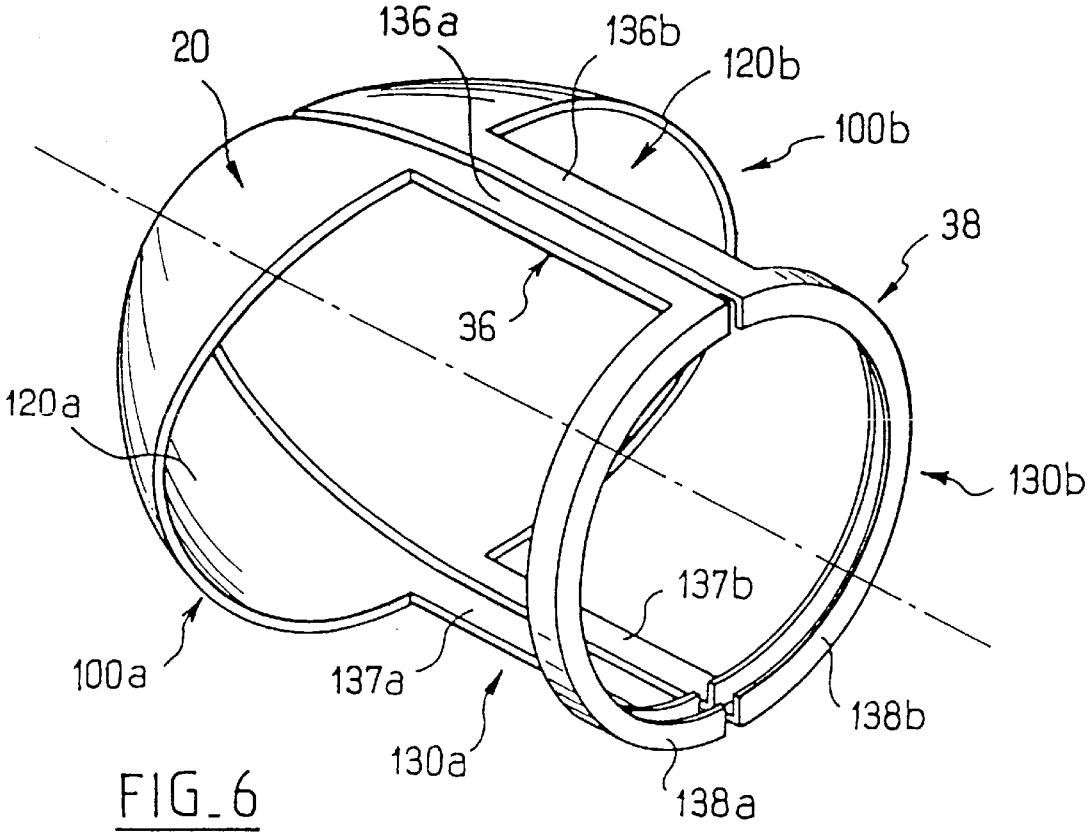
FIG. 6 is a perspective view showing a particular embodiment of part of a headlamp in accordance with the invention.
Figure 7:
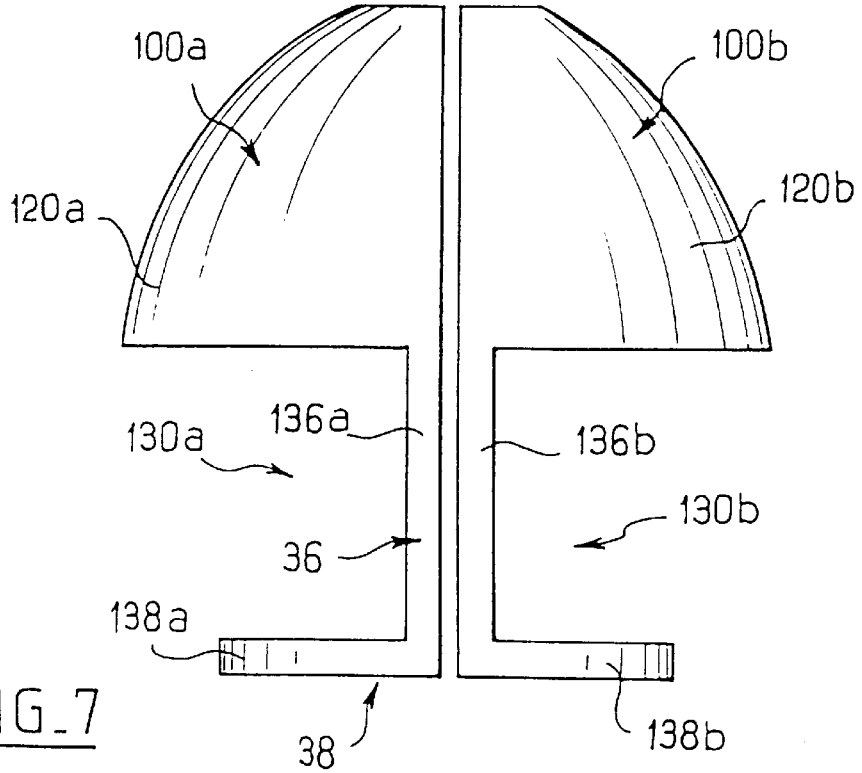
FIG. 7 is a top view of the headlamp part shown in FIG. 6.

FIGS. 6 and 7 show one possible structure of a part of a headlamp in accordance with the invention.

Two components 100*a* and 100*b* are shown, each made in one piece by moulding a plastics material or by pressing sheet metal. They are adapted to be assembled together in a direction essentially perpendicular to the axis x—x of the headlamp.

A first component 100*a* has a first area 120*a* which defines one lateral half of the reflector 20 and a second area 130*a* which defines a corresponding lateral half of the intermediate part 30, with top and bottom arms 136*a*, 137*a* defining between them a window 132*a* through which the direct light passes towards an optical plate (not shown).

The area 130*a* also defines a half-ring 138*a*.

In a symmetrical manner, a first area 120*b* of the second member 100*b* defines the other lateral half of the reflector 20 and a second area 130*b* defines a half-ring 138*b* and top and bottom arms 136*b*, 137*b* defining between them a window 1321) through which the direct light passes towards another optical plate.

The two members 100*a*, 100*b* are assembled together and fixed together (by screws, clips or otherwise) in a vertical plane containing the optical axis x—x of the headlamp, the areas 120*a* and 120*b* together defining the reflector 20 and the areas 130*a* and 130*b* together defining top and bottom arms 36, 37, between which are two openings 32 for the direct light to pass through, and a closed ring 38 adapted to retain the lens 40.

The two half-rings 138*a*, 138*b* preferably each have an internal recess running their full length so that the lens can be held in place merely by moving the two half-rings 138*a*, 138*b* towards each other to trap the edge of the lens in the recess.

This particular embodiment of the reflector and of the intermediate part simplifies manufacture and assembly of the headlamp. It can be adopted for (either embodiment of the invention described hereinabove.

Of course, the present invention is not limited to the embodiments described and shown and the skilled person will know how to vary or modify them within the spirit of the invention.

In particular, the optical plate or plates that enlarge the illuminating area of the headlamp can be provided at any required location relative to the lens, and in particular on either side of the lens, above and below the lens or all around the lens, forming a ring.

In the latter case it is particularly advantageous to dispose the prisms 51 along circular lines concentric with the lens 40.

It is also advantageous for the optical plate to be frosted in order to diffuse the light.

What is claimed:

1. A motor vehicle headlamp comprising:

an ellipsoidal reflector having a first focus region and a second focus region;

a light source in the first focus region;

a convergent lens focused on the second focus region;

an optical plate directly exposed to light emitted by said light source, said optical plate having optical processing means adapted to direct at least a part of light into an illumination field of said headlamp said optical processing means having a prism for increasing size of an illuminating area of the headlamp; and an intermediate part fixed between said reflector and said convergent lens, wherein said intermediate part includes an optical plate fixing device that fixes to said optical plate substantially in alignment with said convergent lens.

2. The headlamp according to claim 1, wherein said intermediate part includes a lens fixing device that fixes to said convergent lens.

3. The headlamp according to claim 2, wherein said optical plate fixing device comprises an arrangement extending along and in the vicinity of a corresponding edge of said reflector.

4. The headlamp according to claim 1, wherein said optical plate has an edge adapted to attach to a corresponding edge of said convergent lens.

5. The headlamp according to claim 1, wherein said convergent lens and said optical plate are made in a one piece component.

6. The headlamp according to claim 5, wherein said one-piece component is retained by said intermediate part through two opposite edges.

7. The headlamp according to claim 6, wherein said intermediate part flares out from said reflector towards said opposite edges.

8. The headlamp according to claim 1, wherein said headlamp comprises two optical plates mounted on opposite sides of said convergent lens.

9. The headlamp according to claim 8, wherein said optical plates are mounted laterally relative to said convergent lens.

10. The headlamp according to claim 1, wherein said optical plate comprises light deflecting means and light diffusing means.

11. The headlamp according to claim 1, wherein said reflector and said intermediate part each comprises two members made in one piece assembled together in a direction substantially transverse to an optical axis of said headlamp.

12. A headlamp comprising:

a reflector having a first focus region and a second focus region;

a light source in the first focus region;

a convergent lens focused on the second focus region;

an intermediate part having a first end and a second end, wherein the first end is fixed to the reflector and the second end is fixed to the convergent lens; and an optical plate having an optical processing device, said optical processing device having a prism for increasing size of an illuminating area of the headlamp, wherein said optical plate is fixed to said intermediate part substantially in alignment with said convergent lens.

13. A headlamp according to claim 12, wherein the light source comprises a lamp mounted in a lamp hole in said reflector.

14. A headlamp according to claim 12, wherein the first end of the intermediate part is fixed to a front edge of the reflector by a flange.

15. A headlamp according to claim 12, wherein the second end of the intermediate part is fixed to the convergent lens by an arrangement comprising a plurality of bearing lugs and crimping lugs.

16. A headlamp according to claim 12, wherein the headlamp is adapted to project a low beam with a "V" cutoff.

17. A headlamp according to claim 12, further comprising a plurality of said optical plates, wherein the optical plates are mounted on opposite sides of the convergent lens and extending substantially in alignment with the convergent lens.

18. A headlamp according to claim 12, wherein the intermediate part includes a masking screen, the masking screen being in a plane perpendicular to an optical axis of said reflector and near the second focus region.

19. A headlamp according to claim 12, wherein the prism is oriented vertically.

20. A headlamp according to claim 12, wherein the intermediate part comprises two lateral windows.

21. A headlamp comprising:

a reflector having a first focus region and a second focus region, an optical axis and a lamp hole;

a light source having a lamp mounted in the lamp hole;

a convergent lens focusing on the second focus region;

an intermediate part fixed between the reflector and the convergent lens, said intermediate part having two windows, a first end and a second end and a masking screen, said first end being fixed to the reflector by a flange, said second end being fixed to the convergent lens by an arrangement having a plurality of bearing lugs and crimping lugs, the masking screen being in a plane perpendicular to the optical axis and near the second focus region; and a plurality of optical plates having a plurality of optical processing devices, said optical processing devices having a prism for increasing size of an illuminating area of the headlamp, the optical plates being fixed to the opposite sides of the convergent lens and substantially in alignment with the convergent lens.

22. A motor vehicle comprising the headlamp of claim 21.

23. A head lamp comprising:

a reflector having a first focus region and a second focus region;

a light source in the first focus region;

a convergent lens focused on the second focus region;

an intermediate part having a first end and a second end, wherein the first end is fixed to the reflector and the second end is fixed to the convergent lens;

means for directing at least part of the light emitted from said light source to an optical plate connected to said intermediate part; and means for directing at least a part of light from said optical plate into an illumination field of said headlamp said means having a prism for increasing size of an illuminating area of the headlamp.

24. The headlamp according to claim 23, wherein said intermediate part further includes means for fixing said convergent lens.

* * * * *